US005228314A

United States Patent [19]

Kawai

[11] Patent Number: 5,228,314

[45] Date of Patent: Jul. 20, 1993

[54] METHOD FOR STORING FRUITS AND/OR VEGETABLES AND A REFRIGERATING CONTAINER THEREFOR

[75] Inventor: Tamotsu Kawai, Setsu, Japan

[73] Assignee: Kanegafuchi Kagaku Kogyo Kabushiki Kaisha, Osaka, Japan

[21] Appl. No.: 690,923

[22] PCT Filed: Oct. 19, 1990

[86] PCT No.: PCT/JP90/01265

§ 371 Date: Jun. 19, 1991

§ 102(e) Date: Jun. 19, 1991

[87] PCT Pub. No.: WO91/06489

PCT Pub. Date: May 16, 1991

[30] Foreign Application Priority Data

Nov. 1, 1989 [JP] Japan ..... 1-128374
Aug. 29, 1990 [JP] Japan ..... 2-228702

[51] Int. Cl.[5] ..... F25B 19/00; B65D 81/18; B65D 85/50; B65D 85/34

[52] U.S. Cl. ..... 62/410; 62/100; 62/169; 62/298; 62/371; 62/457.1; 220/366

[58] Field of Search ..... 62/100, 169, 268, 371, 62/337, 457.1, 457.9, 410; 220/360, 366, 367, 373, 374

[56] References Cited

U.S. PATENT DOCUMENTS 2,585,086 2/1952 Brunsing ..... 62/100 X
3,071,045 1/1963 Budd ..... 62/371 X
3,401,671 9/1968 Axelrod et al. ..... 62/371 X
3,741,815 6/1973 Peterson ..... 220/366 X
4,294,079 10/1981 Benson ..... 62/457.1 X
4,600,117 7/1986 Tzifkansky et al. ..... 220/366
4,615,178 10/1986 Badenhop ..... 62/169 X
4,845,959 7/1989 Magee ..... 62/457.1

FOREIGN PATENT DOCUMENTS 857860 10/1952 Fed. Rep. of Germany ..... 220/366
616 1/1988 Japan .
131982 8/1988 Japan .
112074 9/1962 Pakistan ..... 220/366

*Primary Examiner*—Henry A. Bennet
*Assistant Examiner*—C. Kilner
*Attorney, Agent, or Firm*—Armstrong, Westerman, Hattori, McLeland & Naughton

[57] ABSTRACT

This invention relates to a method of precooling precooled materials such as fruits and vegetables under vacuum, and keeping it in a precooled state for a long time, and to a refrigerating container therefor. Precooling and keeping the precooled state for a long time have been regarded as impossible in the past, but these problems are resolved in this invention even for materials closely stored in the container. This container is formed with ventilating communication conduits of a desired length for providing communication between the inside and outside of the container when the container is closed. As a result, the materials such as the fruits and vegetables can be transported a long distance and stored for a long time with an increased reliability of freshness, yet without deteriorating precooling effects.

4 Claims, 16 Drawing Sheets

(I)

(II)

METHOD FOR STORING FRUITS AND/OR VEGETABLES AND A REFRIGERATING CONTAINER THEREFOR

TECHNICAL FIELD

The present invention relates to a method of storing fruits and/or vegetables, herein produce and a refrigerating container therefor, wherein fruits and/or vegetables are stored in a refrigerating container consisting of a body and a cover made of a foamed synthetic resin; air in the container sealed with the cover is forcibly discharged from the container along with reduction of pressure in a vacuum chamber; and after precooling, the vacuum chamber restores pressure, thereby allowing the inside of the container to return to the atmospheric pressure level.

BACKGROUND TECHNOLOGY

A conventional container used for the vacuum-precooling method is constructed, as shown in FIG. 7, of a container body A made of a foamed synthetic resin and a cover B made of a foamed synthetic resin to be fitted gas-tight on the container body A. There is ventilation through hole C, having a diameter of about 10 mm, in proper positions in the container, in the cover B, for example. Thus, fruits and vegetables are put into the container body A of the refrigerating container. The container is closed with the cover and is placed in a vacuum chamber. When the vacuum chamber lowers its inside pressure to about 3 mmHg, air in the container is forcibly evacuated by ventilation through holes C. Thus, moisture contained in the cooled materials is partially evaporated to derive latent heat for gasification, thereby precooling the materials in the container.

The present Applicant has already disclosed in Japanese Utility Model Publication No. 63-616 this type of container usable for the vacuum precooling method, which has drastically improved the existing technology by forming openings with orifice effects in the vicinity of the fitting portions of the body and the cover.

In the former technology out of the two conventional containers as above mentioned, however, from the instant when the inside of the container is returned to the atmospheric pressure level by causing the inside of the vacuum chamber to restore the original pressure, free air flows are allowed between the inside and outside of the container through the ventilation holes. This is because the ventilation holes have a relatively large diameter. The resulting problems: the temperature of precooled materials gradually approaches the ambient temperature deteriorating the precooling effects and the precooled materials are supplied with oxygen, thereby gradually deteriorating their freshness. In order to solve these problems, therefore, the ventilation holes are sealed from the outside with tape or the like after the precooling operation so that the air flow to and from the inside of the container is blocked. Despite this procedure, however, another problem arises, namely, prolonged working time.

In the latter technology, a great deal of attention in view of potential industrial availability is given since operation without sealing the openings of the container drastically reduces the amount of work. Despite of this advantage, however, the structure may be likely to require "trial-and-error" work to determine orifice shapes. And there is other problem that the orifices acting as the ventilating communication conduits cannot be made longer.

DISCLOSURE OF THE INVENTION

In view of the problems of the prior arts thus far described, the present invention proposes both a method of storing fruits and/or herein produce, and a refrigerating container therefor, in which cooled materials such as produce can be quickly refrigerated by the vacuum-precooling method even if they are sealed in the container. After precooling, free air flow between the inside and outside of the container can be substantially blocked without sealing the communication conduits to and from the inside of the container. When a refrigerating container of high gas-tightness is closed, air confined in the container is temporarily compressed to raise the internal pressure of the container. Then, the cover may not be completely sealed, even if it is in the closed position, or it may be hard to close completely because the pressurized air has no passage for escape because of high gas-tightness. Consequently, the efficient closing operation is disturbed. This disturbance becomes serious when the closing operation is to be automated. The present invention also provides a refrigerating container which can make the best use of heat insulating performances without adversely affecting the gas-tightness of the closed container, while assuring an easy operation for closing the container.

In order to solve the problems thus far described, according to the first embodiment of the present invention, there is a method of storing fruits and/or vegetables, comprising of the following steps: (1) putting to-be-cooled material, such as fruits and/or vegetables in a refrigerating container, which is constructed of a container body and a cover made of a foamed synthetic resin, and placing the refrigerating container sealed with the cover in a vacuum chamber; (2) precooling the materials by evacuating the vacuum chamber to discharge the air forcibly from the inside of the container through ventilating communication conduits of a desired length, which are disposed in proper positions on the container for providing communication between the inside and outside of the container when the container body is closed with the cover, against the viscous resistance and the boundary frictional resistance, which are established when the air in the container flows through the communication conduits; (3) returning the inside of the container to the atmospheric pressure level by causing the vacuum chamber to restore the pressure; and (4) blocking the inflow of the ambient air into the container substantially by the viscous resistance and the boundary frictional resistance of the communication conduits after the container has been taken out from the vacuum chamber. According to the second embodiment, there is exemplified a method of storing fruits and/or vegetables, as set forth in the first embodiment, wherein the cross-sectional areas and/or lengths of the communication conduits are so formed that free air flow may be substantially blocked by viscous resistance and boundary frictional resistance in cases where there is no pressure difference between the inside and outside of the container. According to a third embodiment, there is provided a refrigerating container comprising: a container body and a cover made of a foamed synthetic resin; one fitting means disposed at one of the two fitting faces of the container body and the cover and another fitting means disposed at the other fitting faces designed to be fitted on said one fitting means, wherein one and/or the other fitting means are formed with grooves of a desired length cutting through their fitting faces so that ventilating communication conduits are formed between the fitting means when the container is closed. The grooves are formed so that one end opens into the container and the other end opens to the outside of the container. According to a fourth embodiment, there is provided a refrigerating container as set forth in the third embodiment, wherein the grooves are formed across the corners of the container. Furthermore according to a fifth embodiment, there is provided a refrigerating container as set forth in the third and fourth embodiments wherein the grooves have their cross-sectional areas and/or lengths formed so that free air flow may be substantially blocked by viscous resistance and boundary frictional resistance in cases where there is no pressure difference between the inside and outside of the container.

BRIEF DESCRIPTION OF THE DRAWINGS

FIG. 19 is a graph presenting the experimental data for comparing the cooling performances after precooling operations under vacuum.

BEST MODE FOR CARRYING OUT THE INVENTION

Figure 1:
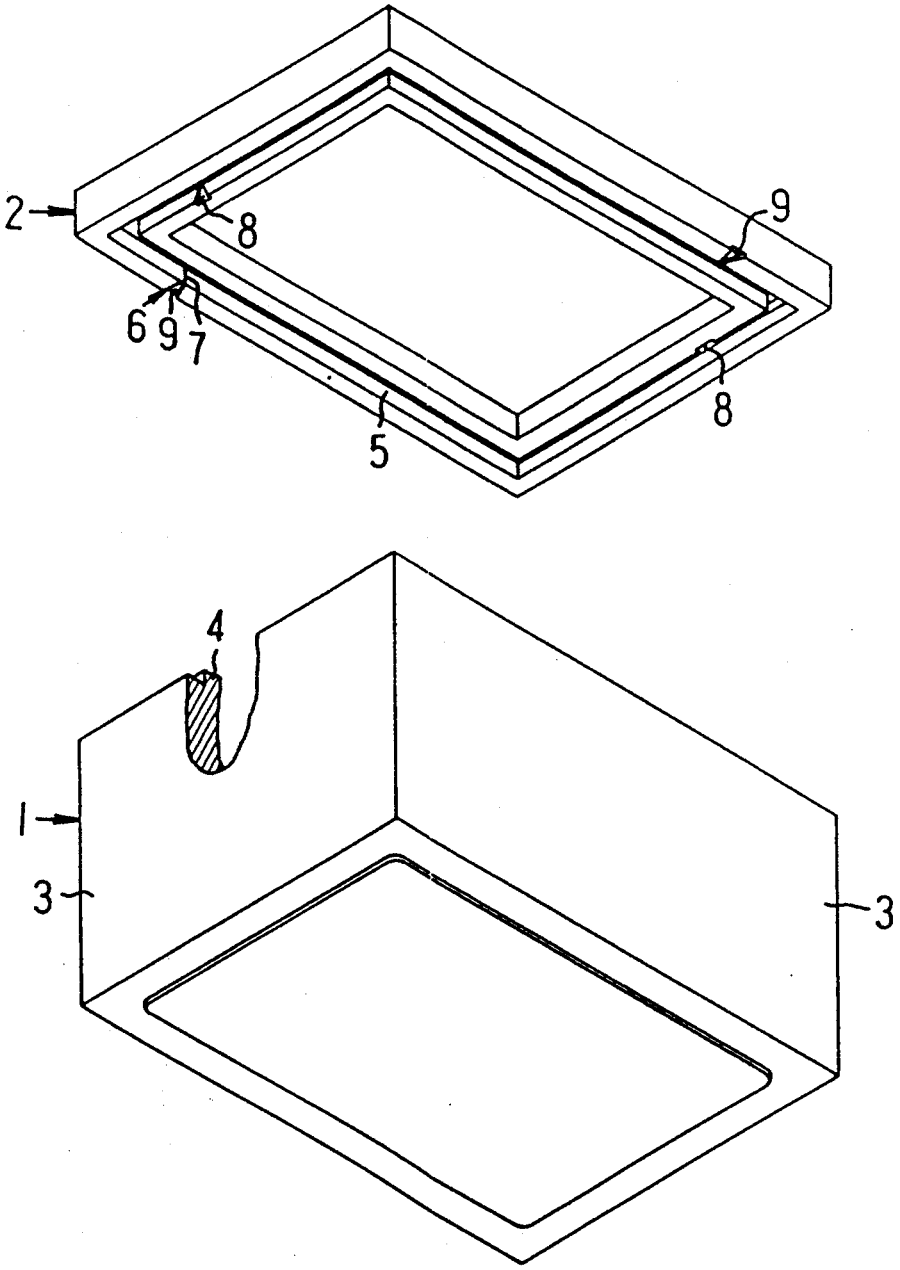
FIG. 1 is a perspective view showing a first embodiment of the refrigerating container to be used for the method of storing fruits and/or vegetables according to the present invention.
Figure 2:
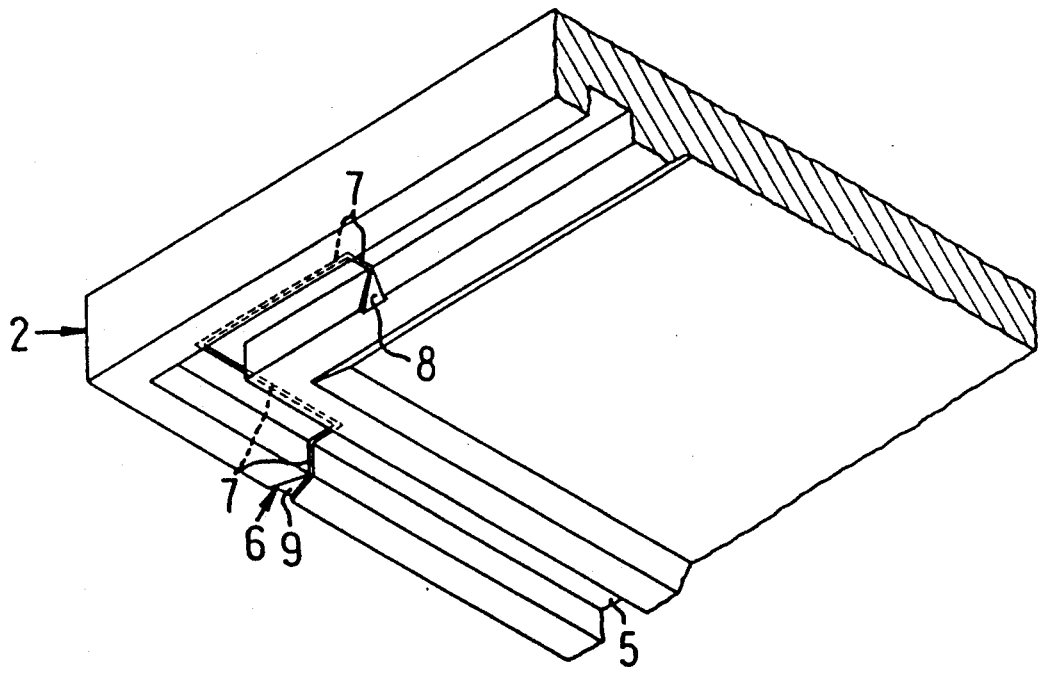
FIG. 2 is also a perspective view showing an essential portion of the first embodiment.

Details of the method of storing fruits and vegetables, according to the present invention, will be further described in connection with the refrigerating container. FIGS. 1 and 2 show a first embodiment of the refrigerating container. Reference numeral 1 appearing in the Figures designates a box-shaped container body made of a foamed synthetic resin and having its top surface opened, and numeral 2 designates a cover which is also made of a foamed synthetic resin for sealing the top opening of container body 1 gas-tight. The refrigerating container is equipped with fitting means for sealing the cover 2 gas-tight on the container body 1. In the first embodiment, as shown, ridges 4 are formed along the side walls 3 of the container body 1 at the inner sides of the top surfaces of side walls 3. Channels 5, to be fitted on ridges 4 are formed at the outer periphery of the lower face of the cover 2. When the container is closed, the channels 5 of the cover 2 are fitted on the ridges 4 of the container body 1. In order to form ventilating communication conduits 6, between the fitted ridges 4 and channels 5, for providing communication between the inside and outside of the container. Grooves 7 are formed across the diagonal corners of the cover 2 so as to extend from the outer sides to the bottom faces of the channels 5. Moreover, each groove 7 is formed, at its one end positioned at the inner side of the corresponding channel 5, with a sector-shaped recess in the inner side of the channel 5 to form an inner opening 8 which is opened toward the inside of the container. The other end of the groove 7 positioned at the outer side of the channel 5 is formed with a sector-shaped recess in the lower face of the outer periphery of the cover 2 to form an outer opening 9 which is opened toward the outside of the container. The cross-sectional area and/or length of the groove 7 is so formed that the free flow of the air may be substantially blocked by viscous resistance and boundary frictional resistance in cases in which there is no pressure difference between the inside and outside of the container when the container is closed. Here, the boundary frictional resistance is based upon the boundary layer theory that an air layer stagnating thin on a surface cannot be removed even if the atmosphere is in a complete vacuum state, and is defined as the resistance which is established between the stagnating thin air layer and the air flowing outside.

Figure 3:
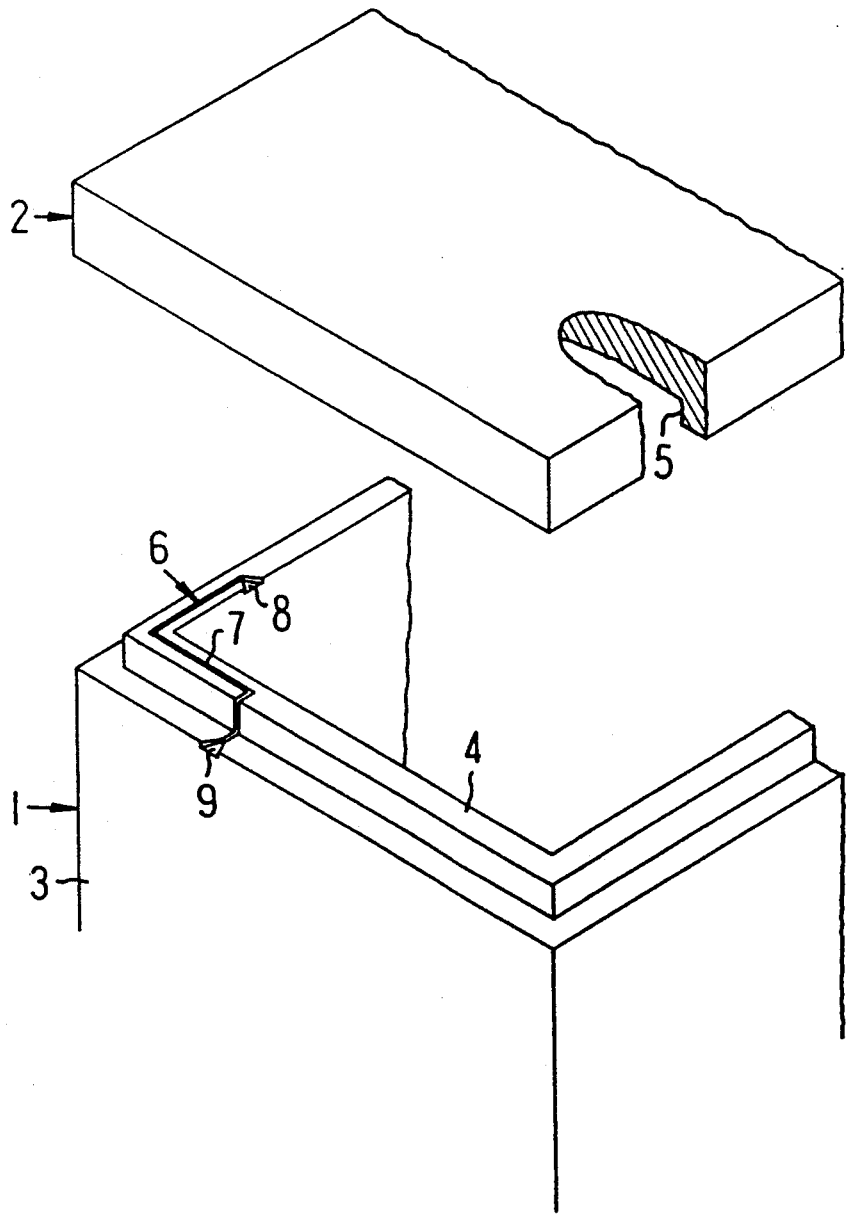
FIG. 3 is a perspective view showing a portion of a second embodiment of the refrigerating container.

Next, a second embodiment of the refrigerating container is shown in FIG. 3. According to this second embodiment, the corners of the ridges 4 formed on the container body 1 are formed with the grooves 7 which extend across the corners from the upper surface to the outer sides of the container body 1, and the inner openings 8 and the outer openings 9 are so formed in the top surfaces of the ridges 4 and in the top surfaces of the side walls 3 outside of the ridges 4, respectively, as to communicate with the grooves 7 by forming the sector-shaped recesses like the first embodiment thereby to form the communication conduits 6 for providing communication between the inside and outside of the container when this container is closed.

Figure 4:
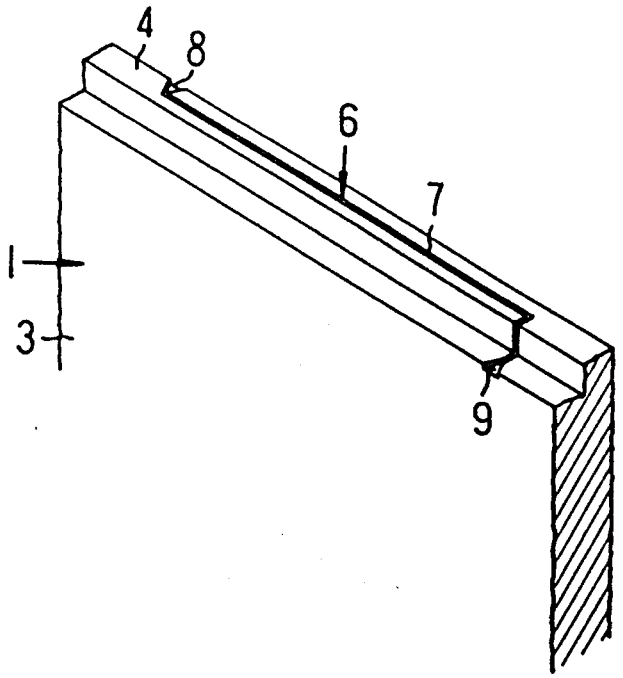
FIG. 4 is a perspective view showing a portion of a third embodiment of the refrigerating container.
Figure 5:
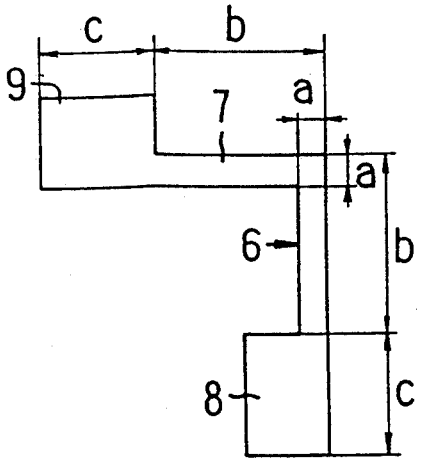
FIGS. 5A and B and FIGS. 6(I) and (II) are explanatory views showing the refrigerating containers according to the present invention for comparing data.
Figure 5:
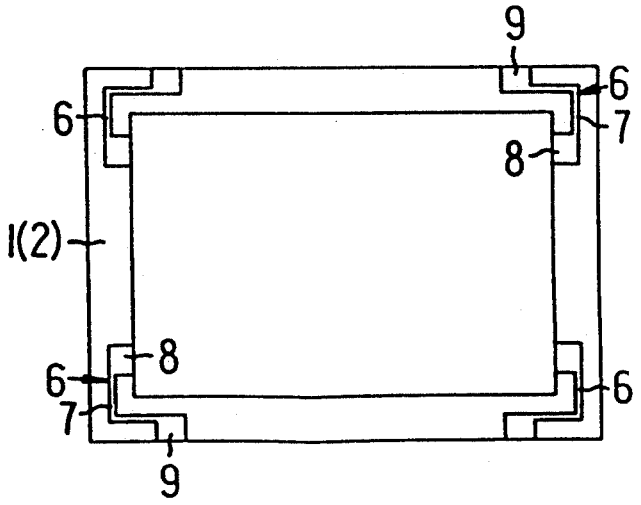

Moreover, a third embodiment of the refrigerating container is shown in FIG. 4. According to this third embodiment, the ridges 4 above the side walls 3 of the container body 1 are formed lengthwise with the grooves 7 extending from the top surfaces to the outer sides of the ridges 4. The inner openings 8 and the outer openings 9 are so formed in the top surfaces of the ridges 4 and the outer surfaces of the side walls outside of the ridges 4, respectively, as to communicate with the grooves 7 by forming the sector-shaped recesses like the first embodiment thereby to form the communication conduits 6.

In short, in these refrigerating containers, the fitting means at the abutting portions of the container body 1 and the cover 2 is equipped with the grooves 7 extending longitudinally, and the inner openings 8 toward the inside of the container extend from the one-side ends of the grooves 7 whereas the outer openings 9 toward the outside of the container extend from the other ends of the grooves 7, to form communication conduits 6 for providing communication between the inside and outside when the container is closed. Thus, materials to be precooled such as fruits or vegetables are put into the container body 1, and this container body 1 is closed with the cover 2. A plurality of containers thus prepared are arranged adjacent to one another and stacked one on another in a vacuum chamber such that at least their outer openings 9 are not clogged. This vacuum chamber is evacuated to about 5 mmHg, for example. Then, the air in the containers is forcibly sucked from the inner openings 8 through the grooves 7 and the outer openings 9 to the outside of the containers. As a result, the moisture kept in the food contained in the containers is partially evaporated to have its latent heat carried away through gasification so that the materials can be precooled to about 2° to 5° C. After this precooling operation, the vacuum chamber has its inside restored to the atmospheric pressure. Then, the air outside of the container is sucked from the outer openings 9 through the grooves 7 and the inner openings 8 into the containers. After the pressures on the inside and outside of the containers have reached the substantially identical level, the containers are filled up with air, which is at a lower temperature and accordingly has a higher density. The air inside the containers is likely stagnant because the outside air is at a higher temperature and accordingly has a lower density. In addition, there are established both viscous resistance which is caused when the air flows through the grooves 7 and boundary frictional resistance which is caused by the air layer stagnating thin on the walls of the grooves 7. As a result, the free air flow between the inside and outside of the containers is substantially blocked.

Despite of the shown embodiments, however, the ridges 4 and the channels 5 acting as one and the other fitting means need not be formed all over the outer periphery of the container but may be formed only at the four corners or one pair of opposed sides of the container. Moreover, the shapes of the inner openings 8 and the outer openings 9 need not be limited to the shown sector-shaped recesses but can be various ones, so long as they can establish viscous resistance and boundary frictional resistance effectively. If those openings are in a slitted shape, for example, they are preferable partly because they can degasify the inside of the container when the inside air is to be forcibly discharged and partly because the air flow can be substantially blocked in cases in which no pressure difference exists between the inside and outside of the container. Furthermore, the grooves 7 can be formed in both one and the other fitting means, i.e., across the ridges 4 and the channels 5.

Figure 6A:
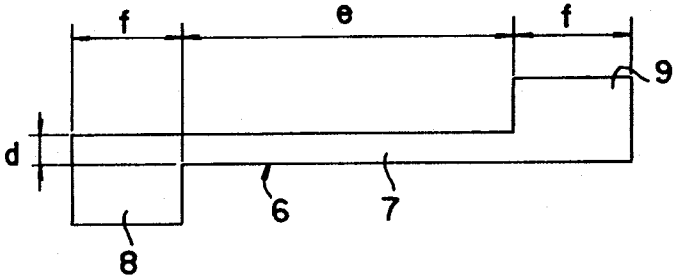
Figure 6B:
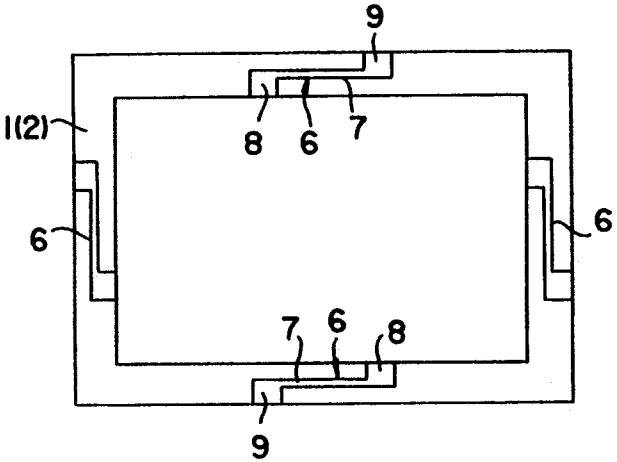
Figure 5A:
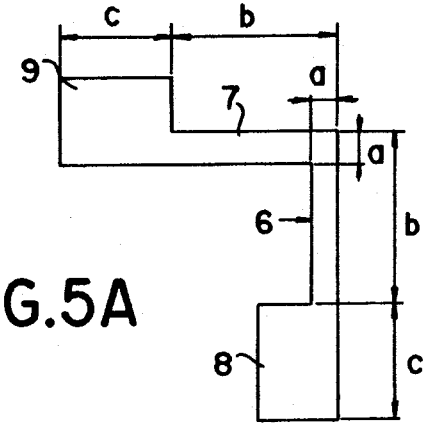
Figure 5B:
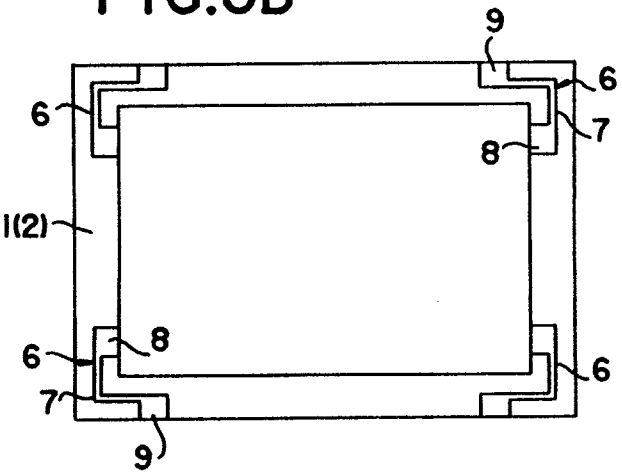
Figure 7:
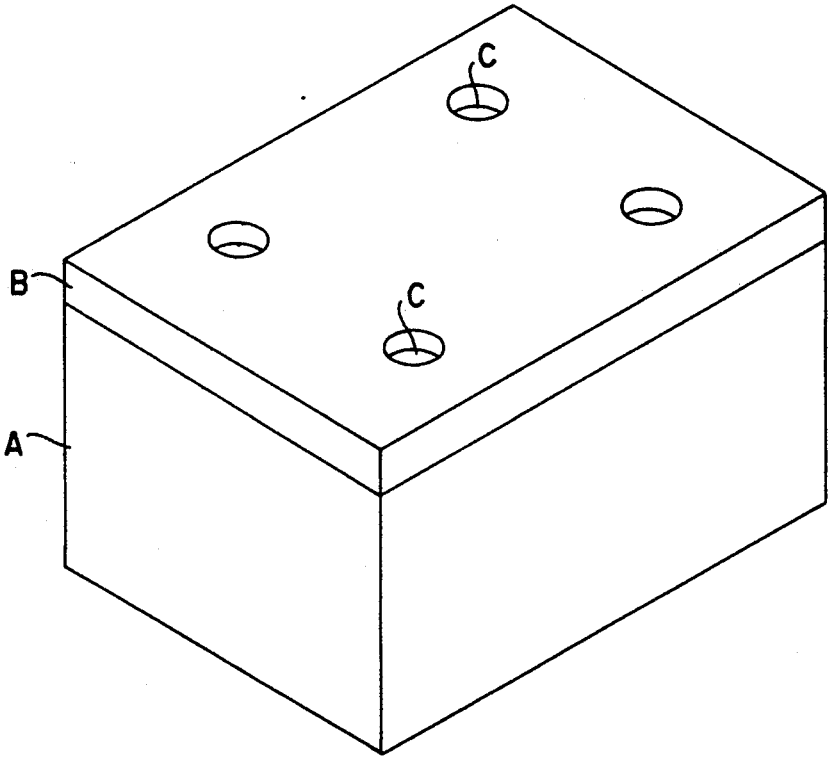
FIG.7 PRIOR ART
FIG. 7 is a perspective view showing a conventional refrigerating container.
Figure 8:
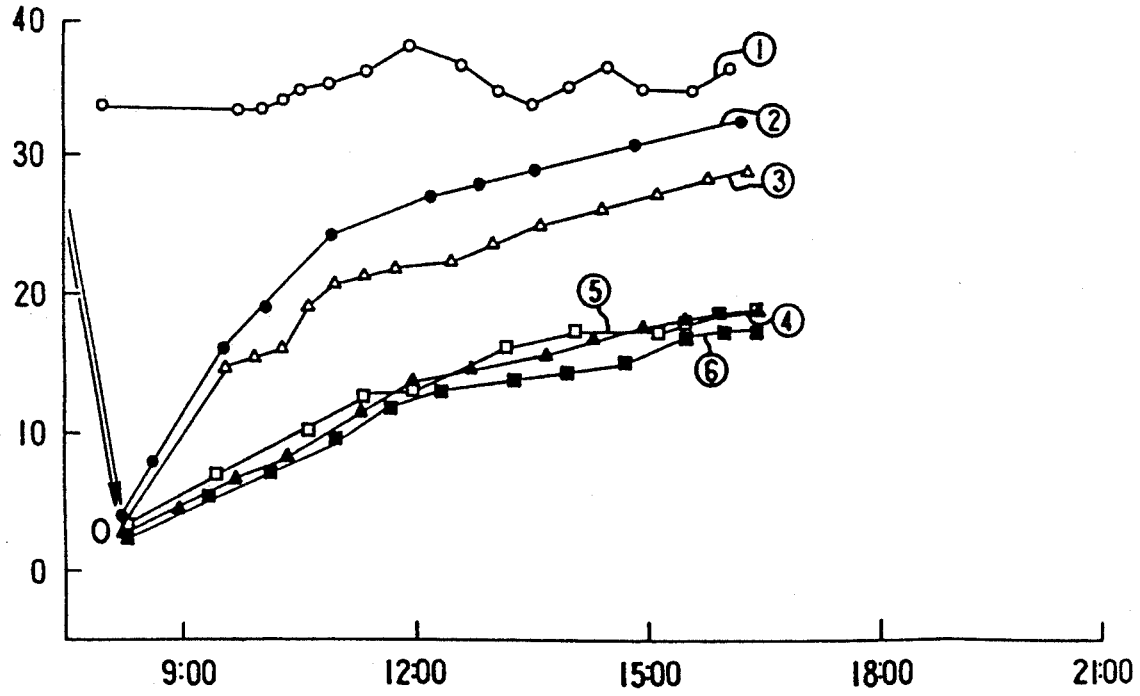
FIG. 8 is a graph presenting the experimental data for comparing performances after precooling operation under vacuum.

Next, FIG. 8 plots the results of experiments comparing the refrigeration effects of the containers of the present invention with those of other arbitrary containers after the materials to be precooled have been contained in the containers. In these experimental results, the ordinate indicates the temperature (°C.), and the abscissa indicates the time. The curve 1 plots the change of the ambient temperature; the curve 2 plots the case of a corrugated cardboard box; the curve 3 plots the case of the refrigerating container which is constructed of a container body A and a cover B made of a foamed synthetic resin, as shown in FIG. 7 and which has its cover B formed with four ventilation through holes C having a diameter of 10 mm; the curve 4 plots the case of the refrigerating container according to one embodiment of the present invention, in which the groove 7 has a width a of 5 mm and a height of 4 mm, the length b from the bent portion to the end of the groove 7 is 30 mm, the inner opening 8 and the outer opening 9 have a width c of 20 mm and a height of 2 mm, as shown in FIG. 5A, in which the container is shaped to have a length 440 mm, a width of 320 mm and a height of 185 mm, as shown in FIG. 5B, and in which the four communication conduits 6 are formed across the corners of the container body 1 or the cover 2 of the container; the curve 5 plots the case of the refrigerating container according to another embodiment of the present invention, in which the groove 7 has a width d of 5 mm, a height of 3 mm and a length e of 60 mm, the inner opening 8 and the outer opening 9 have a width f of 20 mm and a height of 2 mm, as shown in FIG. 6A, in which the container is shaped to have a length of 440 mm, a width of 320 mm and a height of 185 mm, as shown in FIG. 6B, and in which the four communication conduits 6 are formed at positions excluding the corners of the container body 1 or the cover 2 of the container; and the curve 6 plots the case in which the materials to be precooled have been contained in the container body made of a foamed synthetic resin and in which the container body is then externally closed by the cover likewise made of a foamed synthetic resin. And, 2 kg of spinach is contained and precooled in each of those containers. As result, it is found out by comparing the experimental data of FIG. 8, as obtained by precooling the materials to 0 point by the vacuum precooling method, that the refrigerating containers 4 and 5 according to the present invention have cooling effects similar to those of the completely sealed refrigerating container 6 , as compared with the cases of the containers 2 and 3 . These effects can be deduced to come from the fact that the air passing through the groove 7 was subjected to viscous resistance and boundary frictional resistance by the length, width and height of the groove 7 so that the air flow toward the inside and outside of the precooled containers were blocked, unlike the case of the container of the prior art having ventilation through holes of a large diameter, whereby the low temperature in the containers could be kept without any influence from the ambient temperature. Moreover, the kept temperature was substantially equal to that in the completely sealed refrigerating container. In order to increase viscous resistance and boundary frictional resistance, on the other hand, suitable modifications can be made by bending the groove 7, by reducing the cross-sectional area of the groove 7 to be determined by the width and depth, or by elongating the groove 7. Moreover, those effects can be efficiently exhibited by increasing the number of the grooves 7, by reducing the cross-sectional areas or by shortening the grooves 7. It is, therefore advisable, to set the necessary number of grooves and the cross-sectional areas and lengths of the grooves properly by considering the aforementioned requisites.

Figure 9:
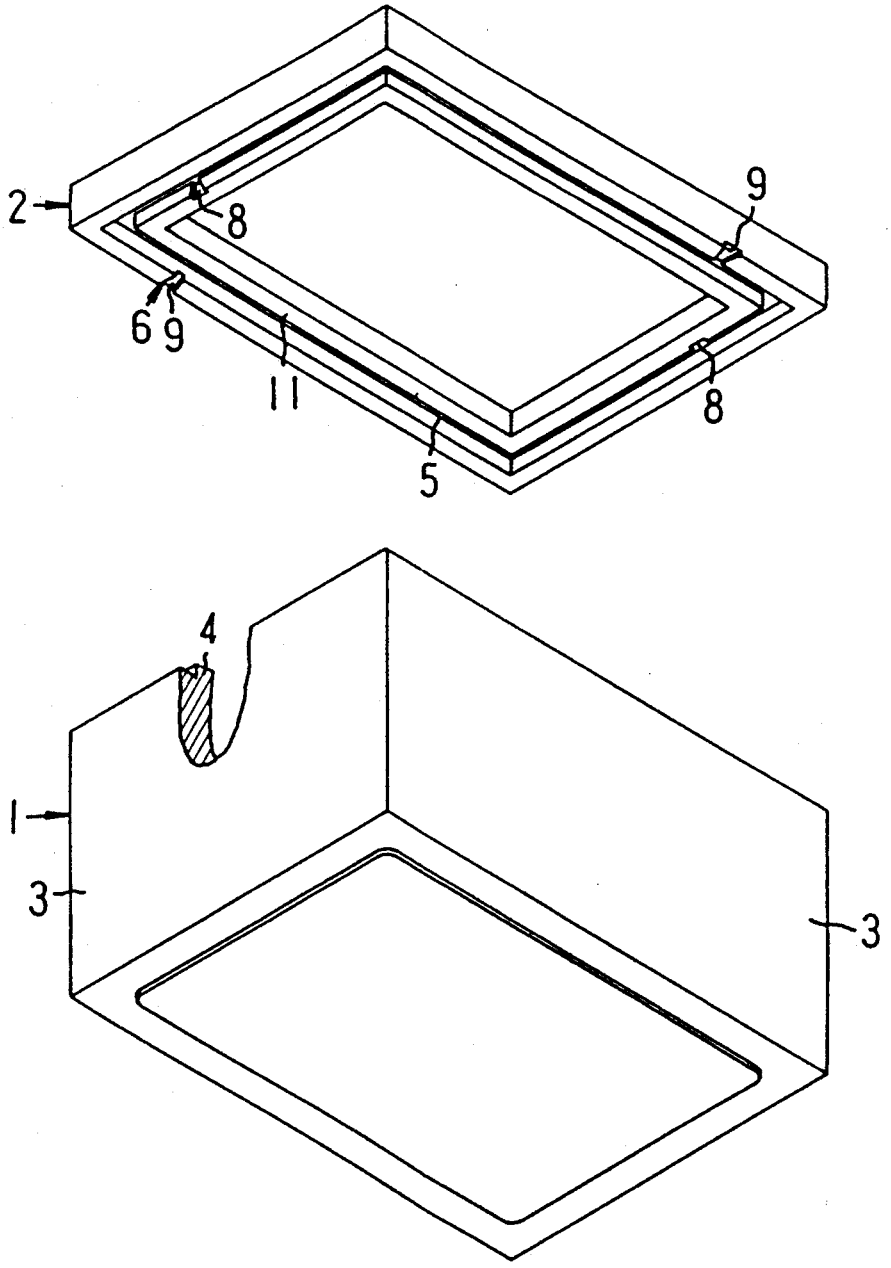
FIG. 9 is a perspective view showing another mode of the refrigerating container.
Figure 10:
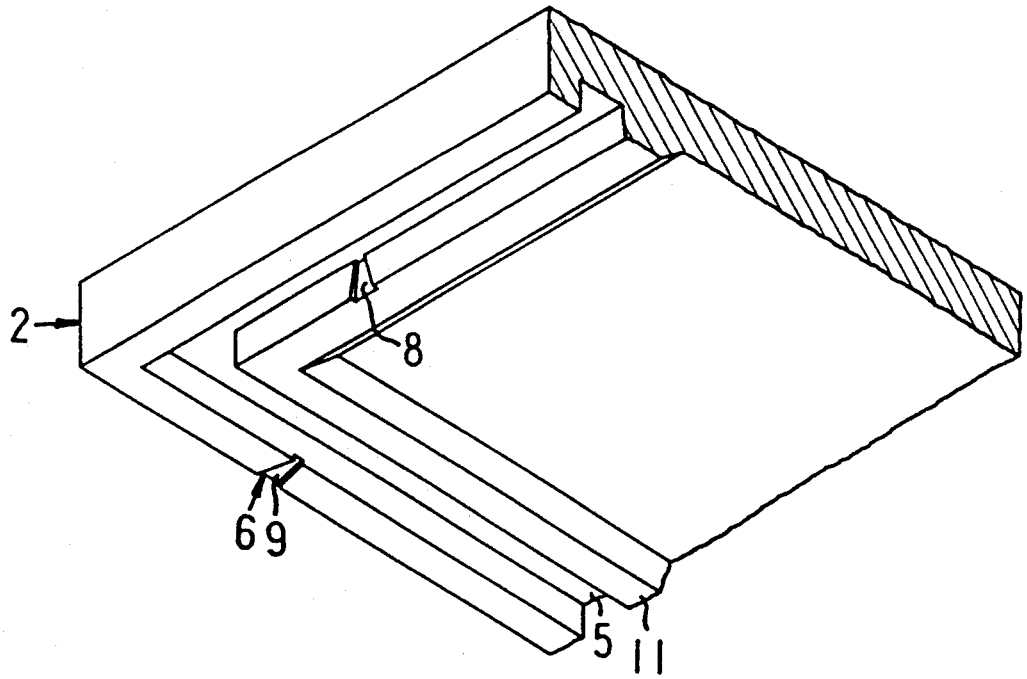
FIG. 10 is a perspective view showing an essential portion of the same.
Figure 11:
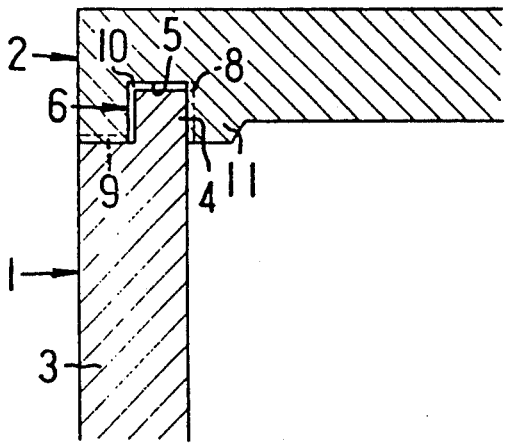
FIG. 11 is a longitudinal section showing an essential portion of the same.

Next, FIGS. 9, 10 and 11 show other modes of the refrigerating container. In this refrigerating container, the ridges 4 are formed all over the side walls 3 of the container body 1 and along the inner sides of the top faces of the side walls 3, and the channels 5 to be fitted on the ridges 4 are formed all over the outer periphery of the lower face of the cover 2. When the container is covered, the channels 5 of the cover 2 are fitted on the ridges 4 of the container body 1. This time, the ridges 4 and the channels 5 have their size and/or position relations determined so that gaps 10, as shown in FIG. 11, may be left between the ridges 4 and the channels 5 at the upper faces and sides of the ridges 4. Incidentally, reference numeral 11 appearing in FIG. 11 designates inward ridges formed on the lower side of the cover 2 and along the inner sides of the side walls 3 of the container body 1 so that they are fitted in the upper portion of the opening of the container body 1. Owing to the inward ridges 11, moreover, the gaps 10 are formed all over the outer periphery of the container when the container is closed. Next, the numerals 8 and 9 designate the inner and outer openings which are formed in the container similar to the refrigerating containers of the present invention such that they extend across the diagonal corners of the container while communicating with the gaps 10 and that they are recessed in different positions into a sector shape. Here, the cross-sectional areas and/or lengths of the gaps are determined so that the air flow may be substantially blocked, in cases where there is no pressure difference between the inner openings 8 and the outer openings 9, by both viscous resistance to be caused by the air passing through the gaps 10 and boundary frictional resistances which are caused between the thin air layer stagnating on the upper faces and outer sides of the ridges 4 and the bottom faces and inner sides of the channels 5. When, moreover, the materials to be precooled such as the fruits and vegetables are contained in the container body 1 and the cover 2 is fitted to close the container body 1, the gaps 10 are formed all over the outer periphery of the container between the ridges 4 of the container body 1 and the channels 5 of the cover 2. As shown in FIGS. 9, 10 and 11, moreover, the gaps 10 are formed to communicate with the inner openings 8 and the outer openings 9 which are formed in the different positions. In short, this refrigerating container has its communication conduits 6 formed by the gaps 10, the inner openings 8 and the outer openings 9.

Figure 12:
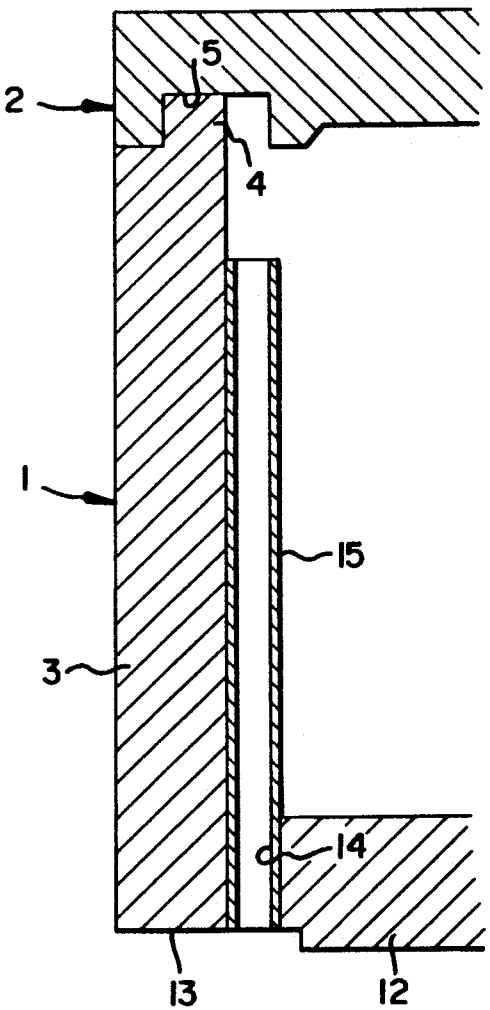
FIGS. 12 and 13 are longitudinal sections showing essential portions of other modes of the refrigerating container.
Figure 13:
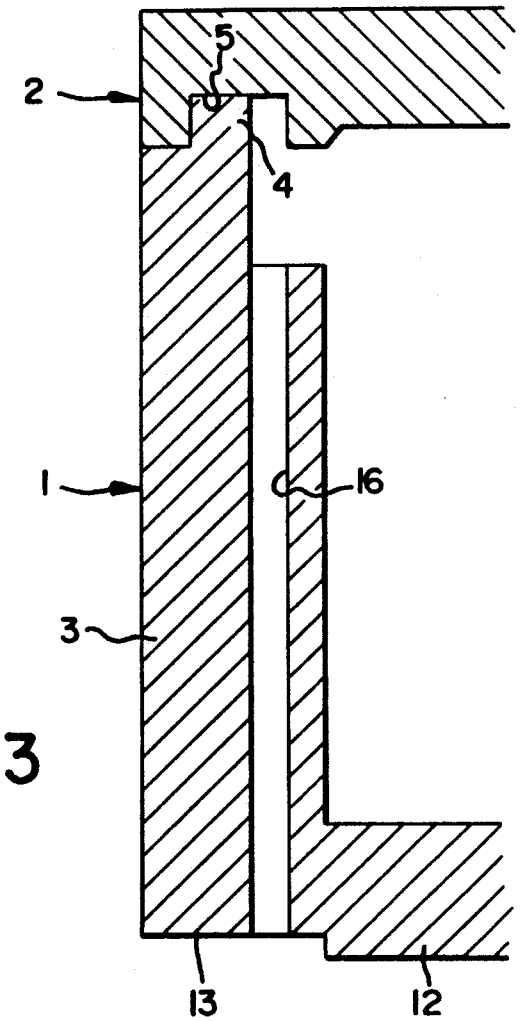

Next, FIGS. 12 and 13 show other modes of the refrigerating container. In the refrigerating container shown in FIG. 12, the communication conduit 6, formed in a suitable position on the container consisting of the container body 1 and the cover 2 of a foamed synthetic resin for providing communication between the inside and outside of the container, is formed of a pipe member 15 of a desired length fitted in a mounting hole 14, which is formed into the container from the outside of the stepped portion 13 of a bottom plate 12 at the outer periphery of the container body 1, and erected into the container. Moreover, the internal cross-sectional area and/or the length of the pipe member 15 is set so that the free air flow may be substantially blocked by viscous resistance and boundary frictional resistance in cases in which there is no pressure difference between the inside and outside of the container. In the refrigerating container shown in FIG. 13, on the other hand, an opening 16 of a desired length for providing communication between the inside and outside of the container constructed of the container body 1 and the cover 2 of a foamed synthetic resin is formed in a suitable position of the container to provide the communication conduit 6. The cross-sectional area and/or length of this opening 16 are also set to block the free air flow substantially by viscous resistance and boundary frictional resistance in cases where there is no pressure difference between the inside and outside of the container.

Here, the refrigerating container can be formed by one or suitable combination of two or more among the following four; the grooves 7, the gaps 10, both of which have one or more inner openings 8 and outer openings 9, the pipe members 15 and the openings 16.

Figure 14:
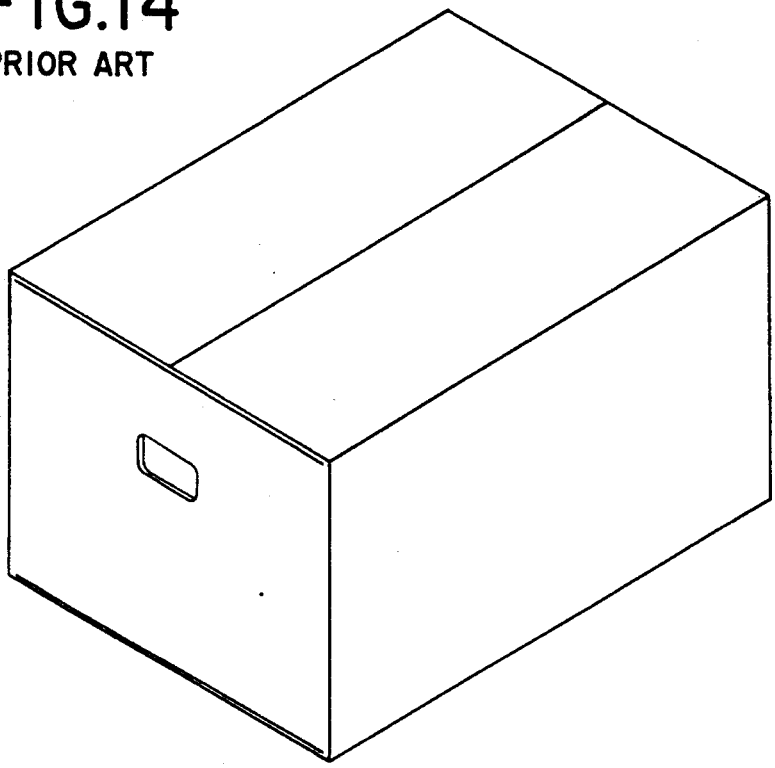
FIG.14 PRIOR ART
FIG. 14 is a perspective view showing a corrugated cardboard box for the comparative example.
Figure 15:
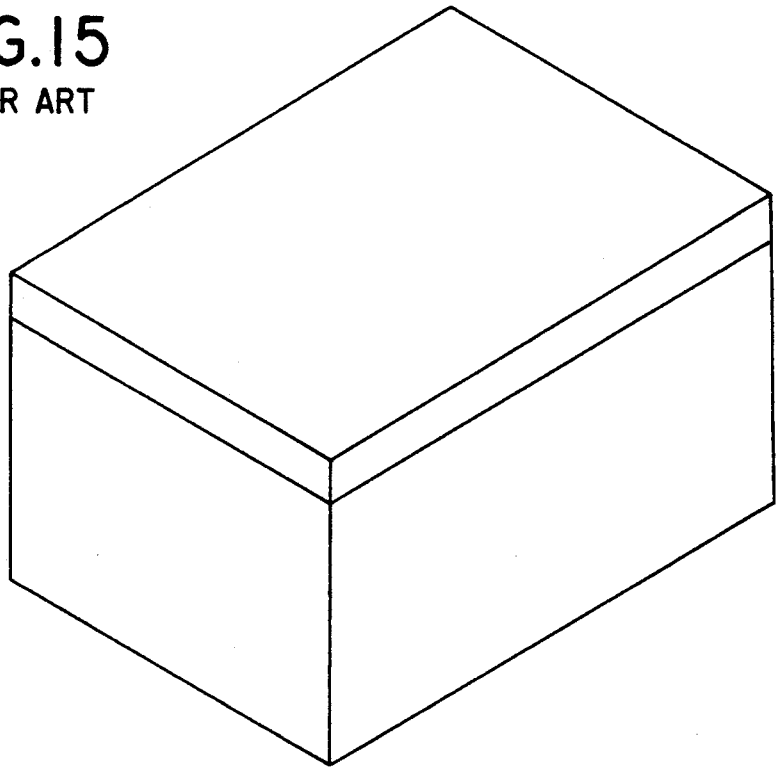
FIG.15 PRIOR ART
FIG. 15 is also a perspective view showing a refrigerating container made of a foamed synthetic resin for the comparative example.
Figure 16A:
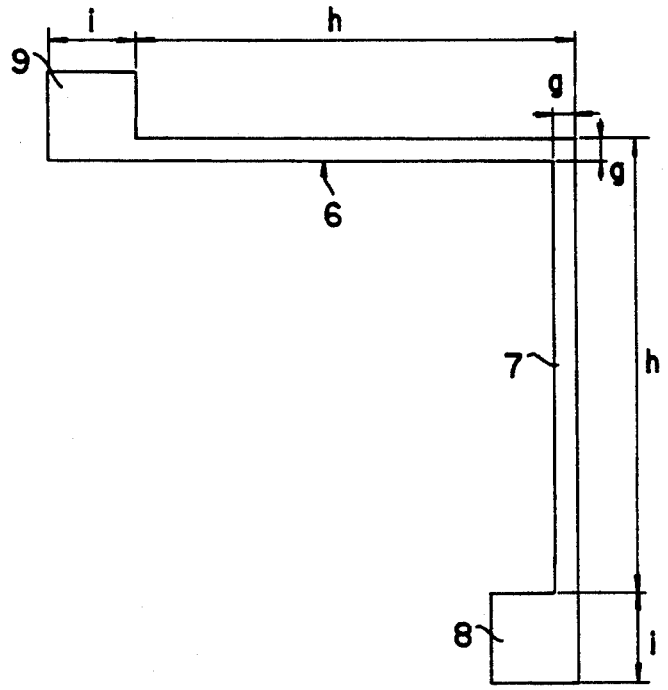
FIGS. 16 A and B are explanatory views showing the refrigerating container according to the present invention for comparing data.

Next, FIG. 19 plots the results of experiments comparing the cooling performances of the containers of the present invention with those of other arbitrary containers after the materials to be precooled have been contained in the containers. In these experimental results, the ordinate indicates the temperature (°C.), and the abscissa indicates the time (hr.). The curve ', as shown in FIG. 19, plots the case of a corrugated cardboard box which has a surface layer of Craft K220 and a heart member of SCP 125 and a surface layer of A flute of Craft K250, as shown in FIG. 14, which has an internal size of a length of 405 mm, a width of 295 mm and a height of 135 mm and which has grip holes at its two sides having a width of 70 mm and a height of 30 mm. The curve ' plots the case of a cooling box which is molded of foamed polystylene of 55 times, as shown in FIG. 15, which has an overall thickness of 20 mm, which consists of the container body and the cover having an internal size of a length of 405 mm, a width of 295 mm and a height of 135 mm and which can be completely sealed up. The curve ' plots the case of a refrigerating container which is identical to that of the curve ' but is formed in its bottom with four ventilation holes having a diameter of 6 mm. The curve ' plots the case of a refrigerating container according to one embodiment of the present invention, which is identical to that of the curve '. The groove 7 has a width g of 5 mm and a height of 5 mm, the length h from the bent portion to the end of the groove 7 is 100 mm, and the inner opening 8 and the outer opening 9 have a width i of 20 mm and a height of 2 mm, as shown in FIG. 16A.

Figure 16B:
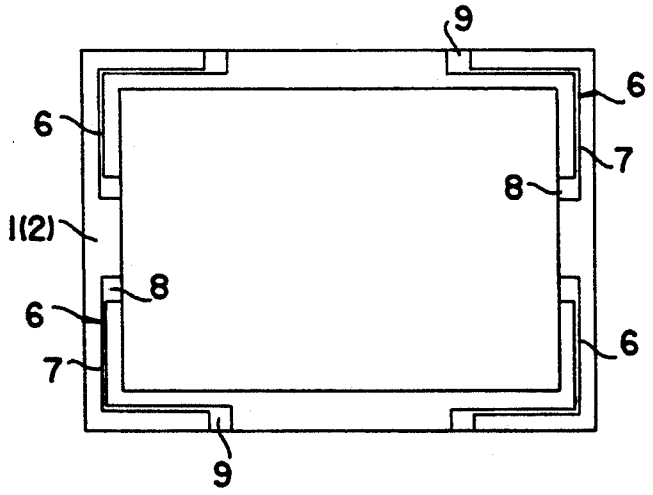
Figure 17:
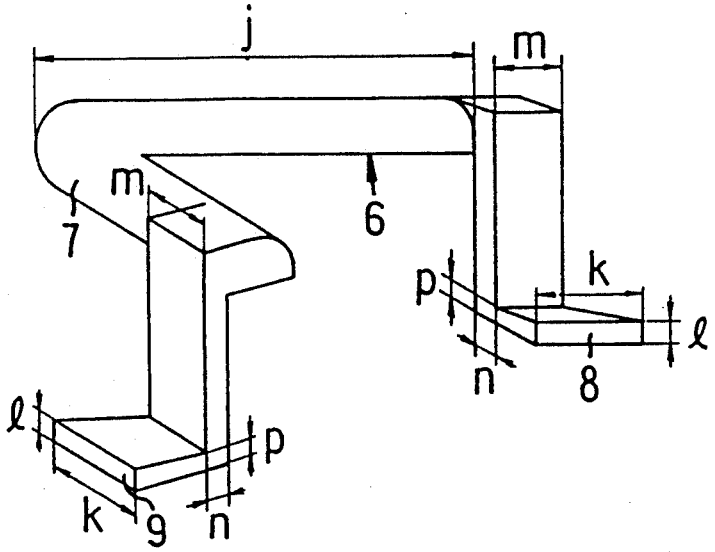
FIG. 17 is also an explanatory view showing an essential portion of the refrigerating container according to the present invention for comparing data.
Figure 18A:
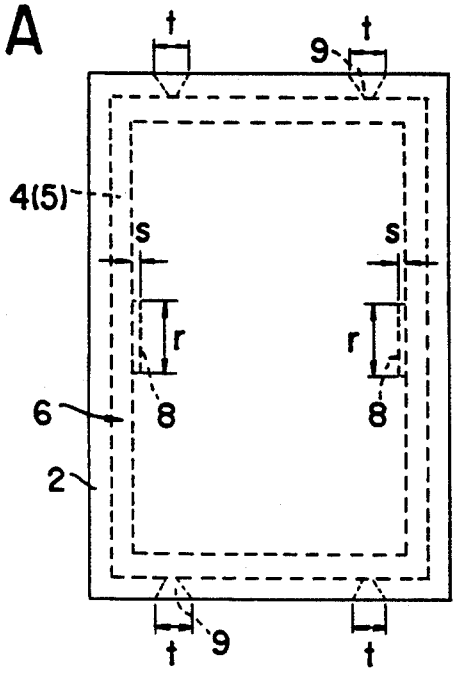
FIGS. 18 A, B and C are a top plan view, a front elevation and a longitudinal section of an essential portion showing another mode of the refrigerating container to be used for comparing data.
Figure 18C:
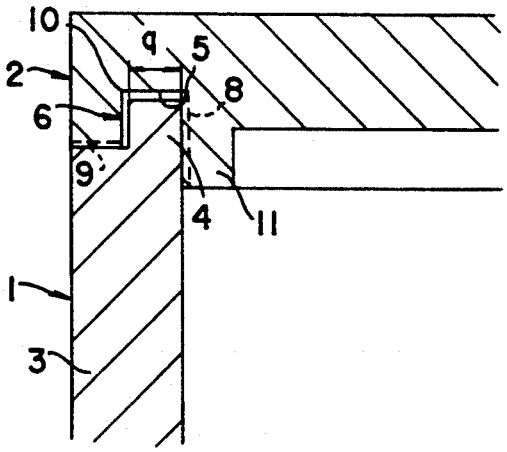
Figure 18B:
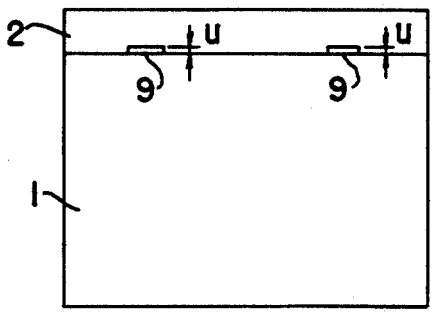

There are four communication conduits 6 across the corners of the container body 1 or the cover 2, as shown in FIG. 16B. The curve ' plots the case of a refrigerating container according to one embodiment of the present invention, in which the refrigerating container is identical to that of the curves ' and '. In the case of ' the groove 7 has a width of 5 mm and a height of 5 mm; the length j from the bent portion to the end of the groove 7 is 100 mm; the inner opening 8 and the outer opening 9 have a width k of 30 mm, a height l of 3 mm at their open sides, and a width m of 15 mm; and the bent side and the fitting side of the groove 7 have heights n and p of 2 mm. There are four communication conduits 6 across the corners of the container body 1 or the cover 2, as shown in FIG. 16B. The curve ' plots the case of a refrigerating container which is identical to that of the curve ' but which has communication conduits 6 created by erecting pipe members 15 having an external diameter of 6 mm, an internal diameter of 5 mm and a length of 120 mm from the outsides of the four corners of the bottom 12 of the container body 1, as shown in FIG. 12. The curve ' plots the case of a refrigerating container which is identical to that of the curve ', in which the ridge 4 of the container body 1 has a width q of 10 mm to form the gap 10 of 2 mm between the upper face and the outer side of the ridge 4, as shown in FIGS. 18A, B and C. The inner opening 8 has a width r of 30 mm and a height s of 2 mm. The outer opening 9 has a width t of 20 mm and a height u of 2 mm. It is made to have the position relations, as shown in A, to form the communication conduit 6. Three kg of chinese vegetables are precooled in the individual containers. As a result, it is discovered from the comparative experimental data of FIG. 19 that both the containers of curves ' and ' according to the present invention and the containers of the curves ' and ' formed with communication conduits for inward and outward communications exhibit viscous resistance and boundary frictional resistance effectively. Experimental data from the container of the curve ' was not available because the container broke during the precooling operation.

AVAILABILITY FOR INDUSTRIAL USE

In the method of storing fruits and/or vegetables according to the present invention, the refrigerating container, which is constructed of the container body and the cover made of the foamed synthetic resin, is formed with communication conduits of the desired length for providing communication between the inside and outside of the container when the container is closed. As a result, the inside of the container can be precooled and returned to atmospheric pressure while the container is closed containing to-be-precooled materials such as fruits or vegetables. Thus, the precooling operation can be made efficient through the vacuum precooling method making use of a vacuum chamber. After the pressure difference between the inside and outside of the container has disappeared after precooling, air occupying the inside of the container is at a lower temperature and a higher density whereas the ambient air is at a higher temperature and a lower density, so that the air is stagnant. In addition, the free air flow into or out of the container can be substantially blocked by viscous resistance and boundary frictional resistance of the communication conduits, so that the temperature rise of the food can be minimized. Since, moreover, the material is supplied with no fresh oxygen, there is no temperature rise due to its respirations and, hence, precooled materials can be kept fresh for a long time. Since, furthermore, the openings of the communication conduits directed to the outside of the container need not be sealed up after precooling, the time period for troublesome sealing can be eliminated. In addition, moisture in the container will not ooze to the outside of the container by capillary action so the container will not get wet. Moreover, when the highly gas-tight container is closed, the communication conduits act merely as passages allowing the escape of internal air pressurized by the closing operation. Thus, the present invention is suitable to the automatic closing operation using machines.

I claim:

1. A method of storing products comprising the steps of: putting to-be-precooled products in a refrigerating container constructed of a container body having an opening therein to an inside of the container and a cover for covering said opening, both said container body and said cover made of a foamed synthetic resin; accommodating the refrigerating container sealed with the cover in a vacuum chamber; precooling the to-be-cooled products by evacuating the vacuum chamber to forcibly discharge air from the inside of the container through ventilating communication conduits against viscous resistance and boundary frictional resistance established when air in the container flows through the communication conduits; said ventilating communication conduits being disposed in positions on the container providing communication between the inside and outside of the container when the container body is closed with the cover and having a longitudinal space of a predetermined length, a first end and a second end of said longitudinal space being disposed longitudinally from one another in a direction around said opening, and said ventilating communication conduits having an inner opening at said first end opened generally perpendicular to said longitudinal space into the container and an outer opening at said second end opened generally perpendicular to said longitudinal space to the outside of the container; said space having cross-sectional areas and length formed such that free air flow is substantially blocked by viscous resistance and boundary frictional resistance when there is substantially no pressure difference between the inside and outside of the container; returning ambient air to the inside of the container to return the inside of the container and the product therein to atmospheric pressure by causing the vacuum in the chamber to restore pressure in said container; and substantially blocking the inflow of the ambient air into the container after the inside of said container has reached atmospheric pressure by viscous resistance and boundary frictional resistance of air through said communication conduits after the container has been taken out of the vacuum chamber and reached atmospheric pressure.

2. A method of storing products as set forth in claim 1, wherein said longitudinal space of a predetermined length is formed at a fitting portion of the container body and the cover and includes a groove along at least one of the container body and the cover.

3. A refrigerating container comprising: a container body and a cover both made of foamed synthetic resin; first fitting means on one of said container body and said cover; and second fitting means on the other of said container body and said cover and fitted on said first fitting means, wherein one of said first and second fitting means are formed with grooves of a desired length cutting across faces of said fitting means, said grooves extending in a longitudinal direction around said container and said grooves having one end formed with openings opening substantially perpendicular to said longitudinal direction into an inside of said closed container and another end formed with openings opening substantially perpendicular to said longitudinal direction to an outside of said closed container, said grooves having their cross-sectional areas and lengths formed such that free air flow is substantially blocked by viscous resistance and boundary frictional resistance when there is substantially no pressure difference between said inside and said outside of said closed container.

4. A refrigerating container as set forth in claim 3, wherein said closed container has corners and said grooves are formed across at least one of said corners of said container.

* * * * *